United States Patent [19]

True et al.

[11] 4,328,736

[45] May 11, 1982

[54] FUSELESS EXPLOSIVE PROPELLANT CARTRIDGE

[75] Inventors: Daniel G. True; Robert J. Taylor, both of Camarillo, Calif.

[73] Assignee: The United States of America as represented by the Secretary of the Navy, Washington, D.C.

[21] Appl. No.: 155,719

[22] Filed: Jun. 2, 1980

[51] Int. Cl.[3] ..... F41D 11/06; F42B 5/20

[52] U.S. Cl. ..... 89/17; 89/1 B; 89/1 F; 102/531

[58] Field of Search ..... 102/431, 443, 469, 530, 102/531; 89/1 F, 1, 704, 1 R, 27 R, 17, 19, 1 B

[56] References Cited

U.S. PATENT DOCUMENTS

| | | | |
|---|---|---|---|
| 2,744,816 | 5/1956 | Hutcheson | 102/531 |
| 3,563,177 | 2/1971 | Ritchey | 102/431 |
| 3,604,355 | 9/1971 | Greenlees | 102/530 |
| 3,618,521 | 11/1971 | Montesi | 102/531 |
| 4,005,876 | 2/1977 | Jorgensen | 102/531 |

FOREIGN PATENT DOCUMENTS

| | | | |
|---|---|---|---|
| 29778 | 6/1958 | Finland | 102/531 |

*Primary Examiner*—Harold J. Tudor

*Attorney, Agent, or Firm*—Robert F. Beers; Joseph M. St.Amand; William C. Daubenspeck

[57] ABSTRACT

An explosive propellant cartridge for use in propellant-actuated devices. The cartridge contains only the explosive propellant which is stable and safe when not confined in a vessel capable of high pressure containment and does not contain the less stable fusing element. The propellant is contained in an annular space between concentric tubes with the inner tube being perforated. An elongated fusing element is inserted into the inner tube after the cartridge is secured in the propellant-actuated device.

8 Claims, 3 Drawing Figures

FUSELESS EXPLOSIVE PROPELLANT CARTRIDGE

BACKGROUND OF THE INVENTION

The present invention relates in general to explosive propellant devices and, in particular, to a fuseless explosive propellant cartridge for propellant-actuated devices.

The explosive propellant used in propellant-actuated devices is relatively stable and safe when not confined in a vessel capable of high pressure containment. However, prior explosive propellant cartridges contained the propellant together with a relatively less safe percussion primer as the fusing element. The possibility of an impact resulting in ignition of the primer adjacent to large quantities of propellant (up to 75 pounds in propellant-actuated embedment anchors, for example) created a substantial hazard transporting or using these cartridges. In case a system malfunction necessitated disarming the device, removal of the cartridge from the device was highly hazardous.

SUMMARY OF THE INVENTION

It is therefore an object of the present invention to provide an explosive propellant cartridge which may be transported and handled more safely than prior cartridges.

Another object of the present invention to provide an explosive propellant cartridge which may be disarmed after deployment in the propellant-actuated device.

Another object of the present invention is to provide a propellant cartridge which permits field adjustment of the propellant charge.

A further object of the present invention is to provide a propellant cartridge in which all transport and handling are completed and the cartridge is shielded and protected by the safety features of the device before the fusing element is brought into proximity with the propellant.

These and other objects are provided by a propellant cartridge including a cylindrical outer tube having an end plate securely fixed to one end and an end plate removably fixed to the other end. The cartridge is typically of plastic or metal material. A perforated tube, concentric with the outer tube, is fixed to one end plate and extends the length of the outer tube, coupling central apertures in the end plates. The chamber between the outer tube and the perforated tube contains propellant which may be inserted through the removable end. The cartridge is inserted into the gun barrel of the propellant-actuated device and a breech block is then secured in the barrel. An elongated percussion primer is then inserted through an aperture in the breech block into the perforated tube. The primer, held in place by the breech block, extends adjacent to the propellant for the length of the cartridge.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
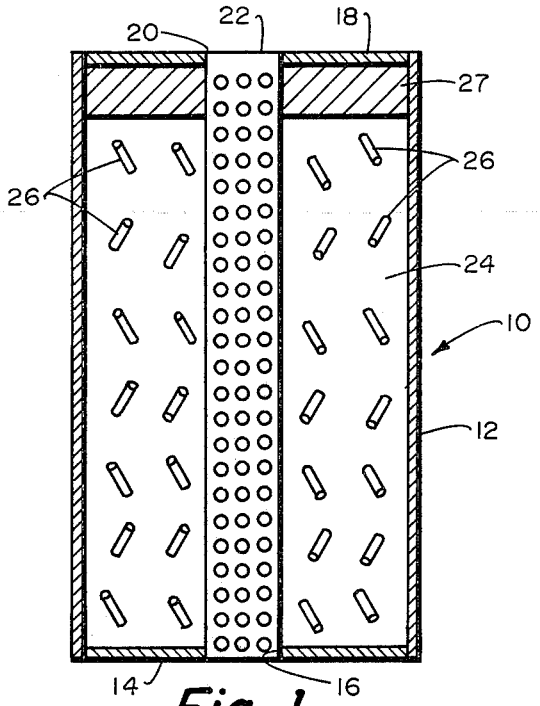
FIG. 1 is a cross-sectional view of an embodiment of the present invention.

Referring now to FIG. 1, a preferred embodiment of the explosive propellant cartridge 10 includes a rigid, phenolic plastic outer tube 12 of cylindrical cross-section. A first rigid end plate 14 of polyvinylchloride (PVC) having a central circular aperture 16 is securely fixed to one end of the rigid tube 12 by a quick setting glue. A second rigid end plate 18 of PVC having a central circular aperture 20 is removably fixed to the other end of the rigid tube 12. A perforated rigid brass tube 22 is fixed to the first end plate 14 and extends longitudinally within the outer tube 12, coupling aperture 16 to aperture 20. The perforated tube 22 is relatively open having a void ratio of approximately 50 percent.

An elongated annular chamber 24 is formed by the concentric tubes 12 and 22, and the end plates 14 and 18. The annular chamber 24 contains a smokeless propellant represented by pellets which may be poured into the annular chamber through the open end of the cartridge where the removable end plate 18 is to be fixed. Although only a few pellets are shown, it will be recognized that the propellant 26 is tightly packed in the chamber 24. Wadding 27 is inserted if needed into the annular chamber 24 to keep the propellant 26 tightly packed. The removable end plate 18 may then be secured to the outer tube 12. The openable end of the cartridge allows field adjustment of the charge, providing flexibility to meet unexpected field conditions.

Figure 2:
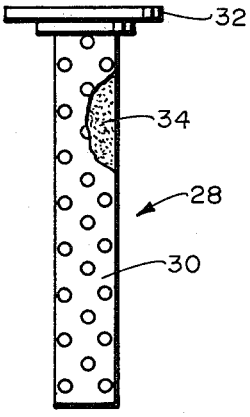
FIG. 2 illustrates a conventional percussion primer used in the present invention.

The perforated tube 22 is adapted for receiving a long slender percussion primer (fuse) 28 of conventional construction shown in FIG. 2. The primer 28 will typically include explosive black powder 34 compressed in a tube 30 having widely spaced perforations and a percussion cap 32.

Figure 3:
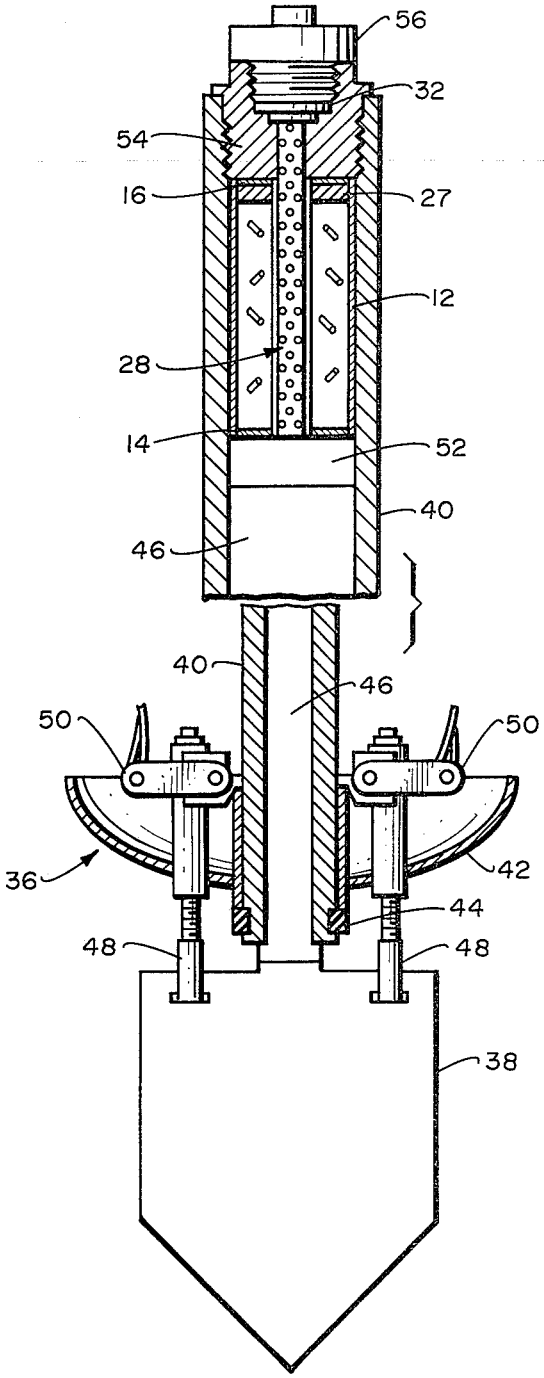
FIG. 3 illustrates the use of the present invention in a propellant-actuated embedment anchor.

The operation and advantages of the fuseless propellant cartridge of the present invention will now be illustrated in connection with its use in a deep water propellant-actuated embedment anchor. Referring to FIG. 3 in which the upper portion is shown in larger scale for clarity, a typical embedment anchor includes a launcher 36 and a fluke 38. The launcher 36 which is only partially shown includes a smooth bored gun barrel 40 and a reaction vessel 42 having an upward facing concave surface secured to the lower end of the gun barrel. A collar 44 is secured into a large groove in the gun barrel 40 under the reaction vessel to transmit the recoil forces from the gun barrel 40 to the reaction vessel.

A piston 46 is disposed in the gun barrel 40. The anchor fluke 38 is drawn against the piston 40 by two anchor links 48 which are each coupled to an emergency release system 50. Upon firing, the links 48 shear allowing the fluke 38 to separate from the launcher and enter the seafloor. The emergency release system 50 allows the fluke 38 to be remotely released from the launcher 36 in case of misfire.

In loading the launcher, a filler 52 is inserted into the gun barrel 40 on top of the piston 44. The cartridge 10 of the present invention is then inserted into the gun barrel on top of the filler 52. The filler 52 is of a length to position the top of the cartridge immediately below a threaded portion at the top of the barrel 40. A breech block 54 having external threads is then screwed into the threaded end of the gun barrel 40.

Until this point in the loading processes, the propellant 26 in the cartridge 10 has been separated from the relatively less stable fusing element 28. However, the cartridge 10 is now confined in the gun barrel 40 and is shielded and protected by the gun barrel and the breech block 54. The percussion primer 28 (the fusing element used in this particular anchor) is now inserted through a central aperture in the breech block 52 with the percussion cap 32 resting in a recessed area on the top surface of the breech block. The primer 28 extends through the length of the perforated tube 22 nearly to the end plate 14. A safe and arm firing device 56 is now threaded into the recessed area of the breech block above the primer 28.

The relatively open characteristic of the perforated tube 22 permits the primer's flash to ignite the propellant properly. The tube 22 also permits the use of a long primer which is adjacent the propellant over a substantial part of the length of the cartridge, providing improved propellant ignition.

If a system malfunction necessitates disarming, the fuseless cartridge permits the remote re-separation of the propellant from the fusing element, reducing the disarming hazard termendously. As illustrated by the embodiment of FIG. 3, there is no mechanical connection holding the cartridge 10 to the primer 28 or the breech end of the gun barrel 40. The activation of the emergency release system 50 then releases the fluke 38 from the launcher 36, allowing the fluke, the piston 44, and the cartridge 10 to drop free from the gun barrel 40 while the percussion primer 28 is retained in the barrel. If the anchor is submerged, seawater will flood the barrel 40, rendering the primer harmless. In any event, the large quantity of propellant 26 is separated from the relatively less stable primer 28. The potential for impact of the primer and resulting ignition of the primer and the propellant in transport and handling is also reduced since the fusing element is separated from the propellant until the final securing of the cartridge and then the primer in the device in which both are to be used.

Obviously, many modifications and variations of the present invention are possible in the light of the above teachings. It is therefore to be understood that within the scope of the appended claims the invention may be practiced otherwise than as specifically described.

We claim:

1. An explosive propellant cartridge for a propellant-actuation device comprising:

a cylindrical outer tube;

a first end plate fixed to one end of said tube, said first end plate having a central aperture;

a second end plate fixed to the other end of said tube, said second end plate having a central aperture;

a perforated inner tube fixed to said first end plate, said inner tube being concentric with said outer tube and extending between the central aperture in said first end plate and the central aperture in said second end plate, an annular chamber being formed by said outer tube, said inner tube, said first end plate, and said second end plate; and a propellant disposed in said annular chamber;

said first end plate being securely fixed to said outer tube and said second end plate being removably fixed to said outer tube to allow the amount of said propellant in said annular chamber to be easily adjusted to provide flexibility in the amount of charge therein for meeting variable field conditions;

said perforated inner tube having a high void ratio, and being adapted for readily receiving an elongated fusing element and operable for being readily reseparated from said elongated fuzing element, remotely, in case of system malfunction, permitting fuzing and defusing of the propellant in said annular chamber, whereby said propellant cartridge can be disarmed after deployment in the propellant actuated device while greatly reducing disarming hazard.

2. The explosive propellant cartridge as recited in claim 1 wherein said outer tube, said first end plate, said second end plate, and the inner tube are of a rigid material.

3. The explosive propellant cartridge as recited in claim 2 wherein said propellant includes pellets of propellant material.

4. The explosive propellant cartridge as recited in claim 3 further comprising wadding means disposed in said chamber for maintaining said pellets of propellant material in a tightly packed condition.

5. The explosive propellant cartridge as recited in claim 1 wherein said perforated tube is relatively open, thereby permitting the ignition flash of a fuse disposed therein to ignite said propellant uniformly.

6. In propellant-actuated device of the type wherein an explosive propellant cartridge is inserted into the breech end of a barrel means and a breech block is then secured behind the cartridge, the improvement comprising a fuseless propellant cartridge adapted to receive a fusing element after said cartridge is inserted in said barrel, said cartridge including:

a rigid outer tube;

a first end plate fixed to one end of said tube, said first end plate having a central aperture;

a second end plate fixed to the other end of said tube, said second end plate having a central aperture;

a perforated inner tube fixed to said first end plate, said inner tube being concentric with said outer tube and extending between the central aperture in said first end plate and the central aperture in said second end plate, an annular chamber being formed by said outer tube, said inner tube, said first end plate, and said second end plate; and a propellant disposed in said annular chamber;

said perforated inner tube having a high void ratio, and being adapted for receiving the fusing element, said fusing element being an elongated fusing element which is inserted into said perforated tube after said cartridge is inserted into said barrel means and said breech block is secured in said barrel means, said elongated fusing element being inserted through an aperture in said breech block, said breech block being adapted to retain said fusing element in fixed relationship to said cartridge, said cartridge and said fusing element having no mechanical connection, thereby readily permitting re-separation of said cartridge and said fusing element, remotely, to disarm said cartridge after deployment in said propellant-actuated device in case of system malfunction, thereby greatly reducing disarming hazard.

7. Apparatus as recited in claim 6 wherein said cartridge may be removed through the muzzle end of said barrel means while the fusing element is retained by said breech block.

8. A device as in claims 1 or 6 wherein the void ratio is approximately 50 percent perforation area.

* * * * *